US008327561B1

(12) United States Patent
Smith, III

(10) Patent No.: US 8,327,561 B1
(45) Date of Patent: Dec. 11, 2012

(54) FOOTWEAR FOR REFRACTING LIGHT FROM AN INTERNAL SOURCE

(76) Inventor: Roy Robert Smith, III, Sugar Land, TX (US)

( * ) Notice: Subject to any disclaimer, the term of this patent is extended or adjusted under 35 U.S.C. 154(b) by 0 days.

(21) Appl. No.: 13/552,289

(22) Filed: Jul. 18, 2012

(51) Int. Cl.
*A43B 23/00* (2006.01)

(52) U.S. Cl. ..... 36/137; 362/101

(58) Field of Classification Search ..... 36/112, 36/45, 136, 137; 362/101, 103
See application file for complete search history.

(56) References Cited

U.S. PATENT DOCUMENTS 4,112,601 A * 9/1978 Chiaramonte, Jr. ..... 36/137
4,130,951 A * 12/1978 Powell ..... 36/137
5,052,131 A * 10/1991 Rondini ..... 36/137
5,879,069 A * 3/1999 Chien ..... 362/103
7,083,296 B2 * 8/2006 Chiang ..... 362/103
7,937,856 B2 * 5/2011 Cook et al. ..... 36/137
8,177,383 B2 * 5/2012 Reuben ..... 362/103
2004/0255490 A1 * 12/2004 Wan et al. ..... 36/137
2005/0150139 A1 * 7/2005 Guzman ..... 36/137
2006/0053663 A1 * 3/2006 Mao ..... 36/137
2006/0174521 A1 * 8/2006 Lee ..... 36/137
2006/0196089 A1 * 9/2006 Guzman ..... 36/137
2010/0170115 A1 * 7/2010 Smith, III ..... 36/137
2011/0192053 A1 * 8/2011 Beers ..... 36/103

* cited by examiner

*Primary Examiner* — Marie Patterson
(74) *Attorney, Agent, or Firm* — Sinorica, LLC

(57) ABSTRACT

An internally illuminated footwear has a light source shining into a translucent component. Boundary sections are created in the translucent component and are arranged to create various visuals, such as designs and logos. The boundary sections are formed by cavities which cut into the translucent component. Abrasive surfaces may be added to the cavities, or replace the cavities and be added to the surface of the translucent component. The cavities may be filled with a boundary material. Bubbles can be formed within the boundary sections and the translucent component. Light waves originate at the light source and travel through the translucent component. Due to different refractive indices, a light wave will be refracted as it encounters cavities in the boundary sections. The refracting light wave will then appear to originate at the cavities. In this manner, the cavities will appear to have their own individual illuminating source.

16 Claims, 9 Drawing Sheets

FOOTWEAR FOR REFRACTING LIGHT FROM AN INTERNAL SOURCE

FIELD OF THE INVENTION

The present invention relates generally to a means of illuminating details, embellishments, and designs in footwear by refracting light waves from a light source.

BACKGROUND OF THE INVENTION

There are many different types of footwear and footwear accessories. A common addition to footwear is some sort of illuminating device. These illumination devices can form designs, logos, or other visual effects. They can also serve simply to add visual appeal to footwear by providing a pleasing light display. While these illuminated footwear are appealing, especially to children, there are some drawbacks. To fully illuminate a shoe may require many light sources. With each additional light source, the shoe will require additional circuits to power the light sources, and potentially require a larger power source. This will increase the weight and cost of the shoe. Each additional light source will also cause the shoe to be more susceptible to inclement conditions, such as rain. In an ideal situation, a shoe could appear to be illuminated using a minimum amount of light sources. It is therefore an object of the present invention to provide a method for refracting light from a light source to make a shoe appear as though it has many individual illuminating devices. The present invention utilizes the light generated from a light source to refract light, making it appear as though visual designs on parts of the shoe are illuminated by their own light source.

The present invention refracts light by providing a light source, and a translucent component, of which the translucent component thus defines the illumination path. Light waves originate at the light source and follow the illumination path, being refracted as they cross boundary sections created in the translucent component. These boundary sections, which can be used to form various designs, then appear to be individually illuminated to a viewer.

DETAILED DESCRIPTION OF THE INVENTION

All illustrations of the drawings are for the purpose of describing selected versions of the present invention and are not intended to limit the scope of the present invention.

Figure 1:
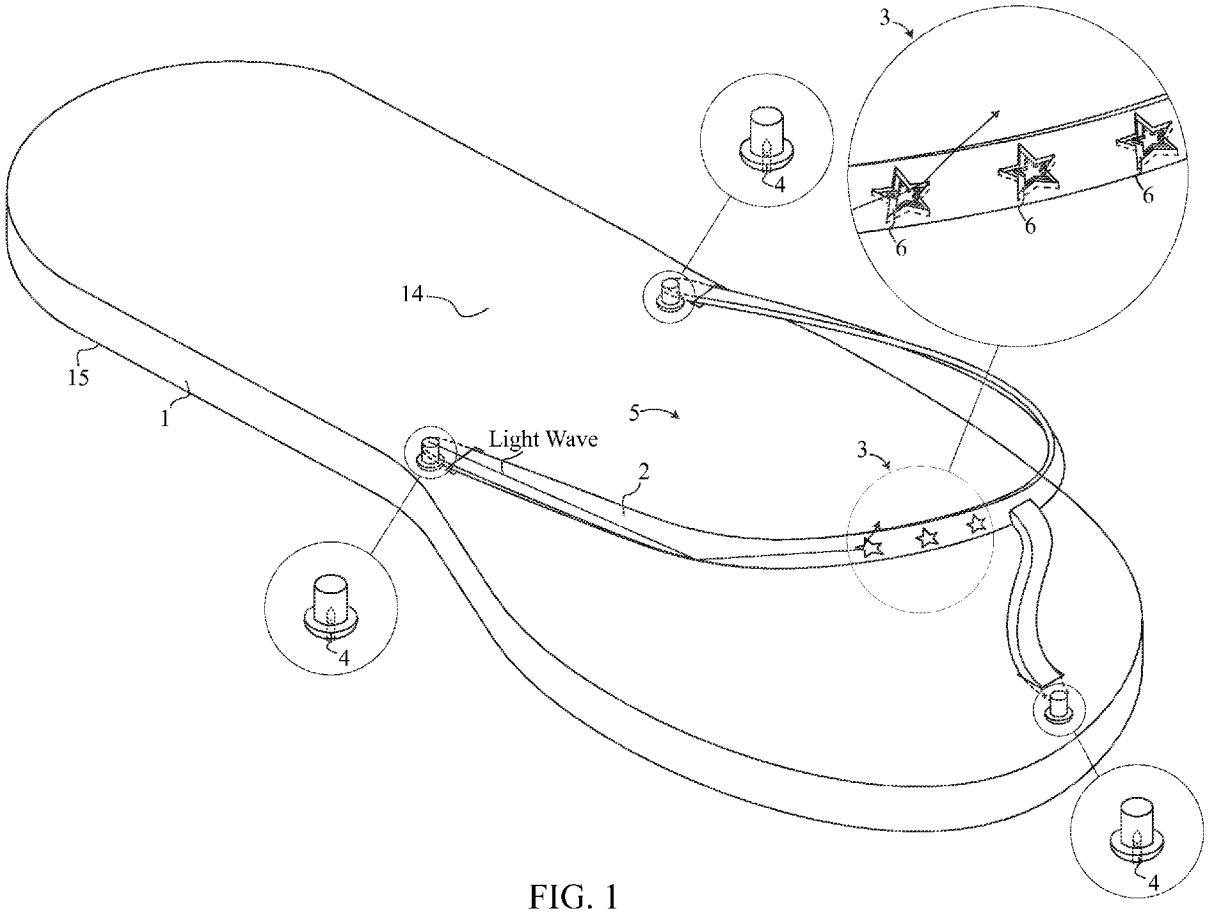
FIG. 1 is a perspective view of the present invention.

A shoe, which refracts light from an internal light source, comprises a shoe base 1, a translucent component 2, a plurality of refractive boundary sections 3, and at least one light source 4. The translucent component is generally but not limited to the upper of the shoe. The light source 4 shines into the translucent component 2, illustrated in FIG. 1. The translucent component 2 is connected to the shoe base 1 while the boundary sections 3 are located along the translucent component 2.

The shoe base 1 comprises an electrical housing 12 and a power source 13. The electrical housing 12 is recessed into the shoe base, such that a person's foot will not come into contact with the electrical housing 12. The electrical housing 12 is encased by an insole 14 and outsole 15 and is not visible. The insole 14 covers the shoe base 1 and provides comfort for a wearer's foot while hiding the electrical housing 12 and power source 13 from view. The power source 13 is stored within the electrical housing 12 and is used to power at least one light source 4. In the preferred embodiment the power source 13 includes a battery and wires to transfer power to the light sources 4, but in other embodiments other means of power supply can be used. The shoe base 1 can be constructed from a variety of materials. Ideal materials will allow the translucent component 2 to easily be connected to the shoe base 1. Ideal materials will also be inexpensive and comfortable, as the shoe base 1 will have to support the feet of users. The shoe base 1 will have connection points where the translucent component 2 is secured. The method of connecting the shoe base 1 and translucent component 2 will depend on the general type of shoe and translucent component 2 being used.

The translucent component 2 further comprises refractive boundary sections 3. The boundary sections 3 are formed by a plurality of cavities 6 cut from or molded within the translucent component 2. The boundary sections 3 can vary in size. The cavities 6 penetrate into the translucent component, or optionally can penetrate completely through the translucent component. The boundary sections 3, which refract light, can be used to create illumination for multiple lettering, shapes, or designs from the same light source 4. The cavities 6 of the boundary section 3 may be left "empty", in which case the boundary medium would be air. Alternatively, the cavities 6 may be filled with a boundary material 7. The boundary material 7 should be translucent, allowing some light to pass through. The boundary material 7 should also be different than the translucent component 2; in other words, the boundary material 7 should have a different refractive index than that of the translucent component 2. If the boundary material 7 and the translucent component 2 have the same refractive index, then the boundary sections 3 will not refract any light passing through said boundary sections 3 and cavities 6. The translucent component 2 can be any material allowing at least some light to pass through, e.g. being translucent or transparent.

Figure 9:
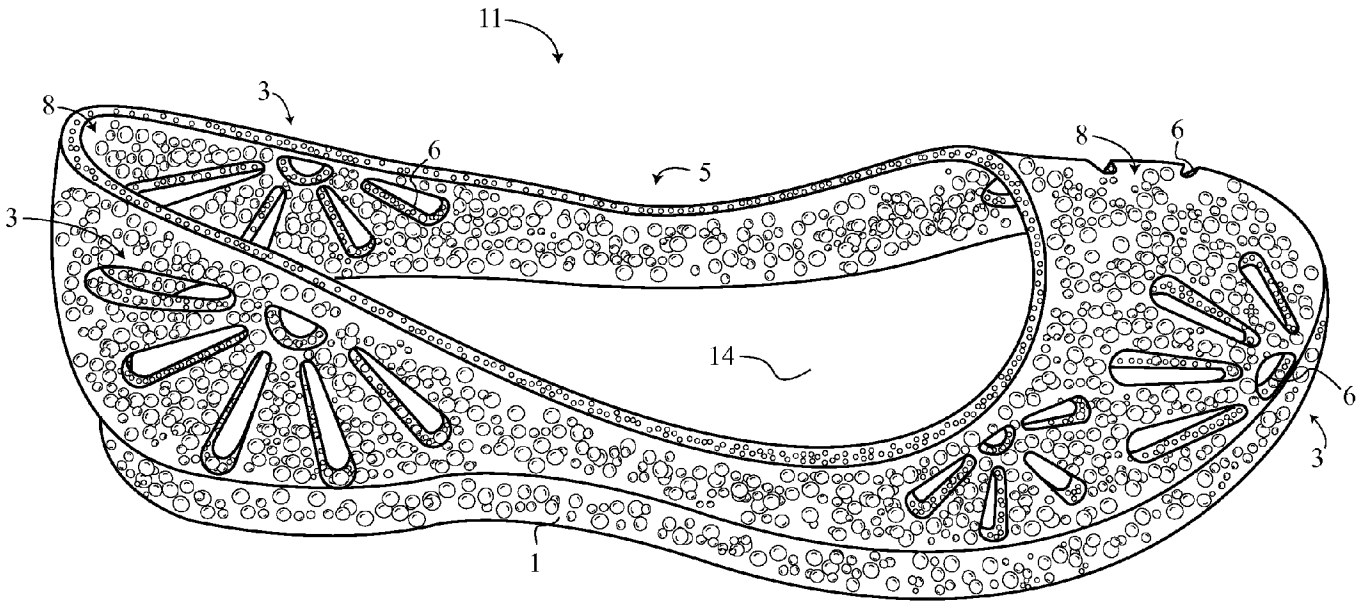
FIG. 9 is a side perspective view of another embodiment of the present invention.

The boundary material further comprises a plurality of bubbles 8, illustrated in FIG. 9. These bubbles 8 form internal cavities within the boundary material. The bubbles 8, similar to the boundary sections 3 as a whole, will refract any light that passes through the bubbles 8. In addition to or instead of being placed within the boundary sections 3, the bubbles 8 could be placed directly within and throughout the entire translucent component 2 or a translucent enclosure 11, a shown in FIG. 9. Alternatively, additional reflective materials such as "glitter" (e.g. metallic flakes) could be added to the translucent component, further enhancing the aesthetic appeal of the present invention.

The boundary sections 3 and cavities 6 can be positioned anywhere on the translucent component 2. These cavities 6 can be on the perimeter of the translucent component 2 or, as with the bubbles 8, can be completely encased within the translucent component 2. Alternatively, the translucent component 2 may be further enhanced by the addition of solid objects such as metallic flakes or beads; with semi translucent materials, again in the form of flakes and beads; or a combination of the aforementioned. These enhancements would refract light, thus providing further visual appeal and variations.

In other embodiments an abrasive surface could be added to enhance or replace the cavities 6. Instead of cavities 6, an abrasive surface could be created on the outer surface of the translucent component 2 by means such as sandblasting. The abrasive surface could be applied to all outer surfaces of the translucent component 2, or could be randomly dispersed across the translucent component 2, or be arranged to create designs, logos, graphics, or similar features. It is also possible to give an abrasive surface to the cavities 6 themselves, resulting in the external surface 16 of the cavities being coarse while leaving the surface areas of the translucent component 2 smooth. The abrasive surfaces would essentially act as miniature cavities 6, refracting light in the same manner as the boundary sections 3. In this way the abrasive surfaces can be used to replace or enhance the cavities 6 on the translucent component 2.

The light source 4 is housed within the shoe base 1 and connected to the translucent component 2 and must emit light into the translucent component 2. For example, the light source 4 could be placed in an indented hole in the translucent component 2, thus securing the light source 4 while allowing the light source 4 to illuminate the translucent component 2.

Figure 8:
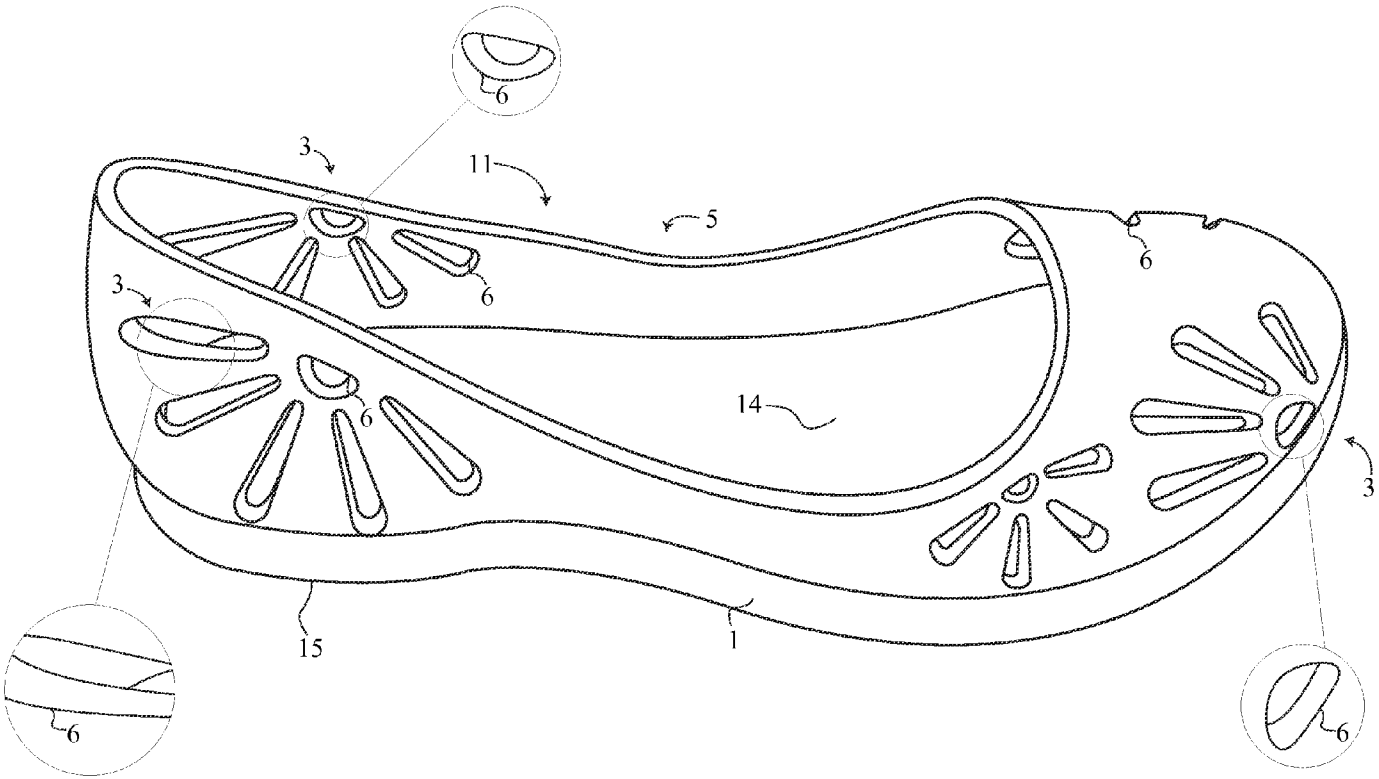
FIG. 8 is a side perspective view of another embodiment of the present invention.

The internally refracting shoe may be built in different embodiments. For example, the internally refracting shoe could simply be flip-flops, wherein the translucent component 2 is an upper (straps) that holds the feet down, an example of which can be seen in FIG. 1. Alternatively, the shoe could be designed in a ballet or slipper style (depicted in FIG. 6, FIG. 7, FIG. 8, and FIG. 9), wherein the present invention would comprise a translucent enclosure 11. As with the translucent component 2, the translucent enclosure 11 would serve as an illumination path. The translucent enclosure 11 would have a foot opening 5 to allow a foot to be placed within the translucent enclosure 11. The translucent enclosure 11 would be formed from both a translucent shoe base 1 and an upper. Similar to how the upper in the flip-flop version is the translucent component 2, in the ballet version the upper is the translucent enclosure 11. As with the preferred embodiment, the translucent shoe base 1 would comprise an electrical housing 12 and a power source 13. The light source 4 would be connected to both a translucent shoe base 1 and the power source 13, thus internally illuminating the translucent shoe base 1 and the translucent enclosure 11. The insole 14 would cover these internal components, as shown in FIG. 8 and FIG. 9, and provide a comfortable support for a wearer's foot, similar to the preferred embodiment. Since the translucent shoe base 1 houses the light source 4, the light travels through and illuminates the translucent shoe base 1 before traveling through and illuminating the full translucent enclosure 11. In the case of a translucent enclosure 11, the plurality of boundary sections 3 and the bubbles 8 would be placed along the translucent enclosure 11, the translucent shoe base 1, or both rather than along a translucent component 2. In general, the shoe base 1 itself can be made from a translucent or transparent material, as can any and all parts of the footwear (such as uppers, soles, mid-soles, in-soles, straps, shafts, and so on) which may comprise a shoe, sandal, or boot design. Boundary sections 3 and light sources 4 could also be added to these additional components, resulting in the entire footwear being illuminated internally, including the sole. These are just a few examples of different embodiments that can be built for the present invention.

The method for refracting light in footwear has slightly different effects depending on the boundary sections 3, cavities 6, and the translucent component 2, translucent enclosure 11, or translucent shoe base 1, but the general procedure remains the same. The light source 4 illuminates the translucent component 2. The light source 4 shines into the translucent component 2, which defines the illumination path. As a light wave travels through the translucent component 2, it will periodically encounter boundary sections 3. When a light wave encounters a boundary section 3 the light wave is refracted as it passes through the cavities 6, with the light wave changing direction each time it is refracted or "bends". This is a result of the different refractive indices of the translucent component 2 and the boundary section 3. The different refractive indices will result in the light wave bending as it crosses from the translucent component 2 to the cavities 6 in the boundary section 3. Depending on the angle of incidence and the location of the cavities 6, there are several directions in which the light wave might bend. In each instance, the light wave will refract each time it travels between mediums; either from a first medium (the translucent component 2) to a second medium (the cavities 6 in the boundary section 3, which are either empty cavities 6 or filled with a boundary material 7), from the first medium to a third medium (the area external to the translucent component 2, usually this will be air), from the second medium to the first medium, or from the second medium to the third medium.

Figure 2:
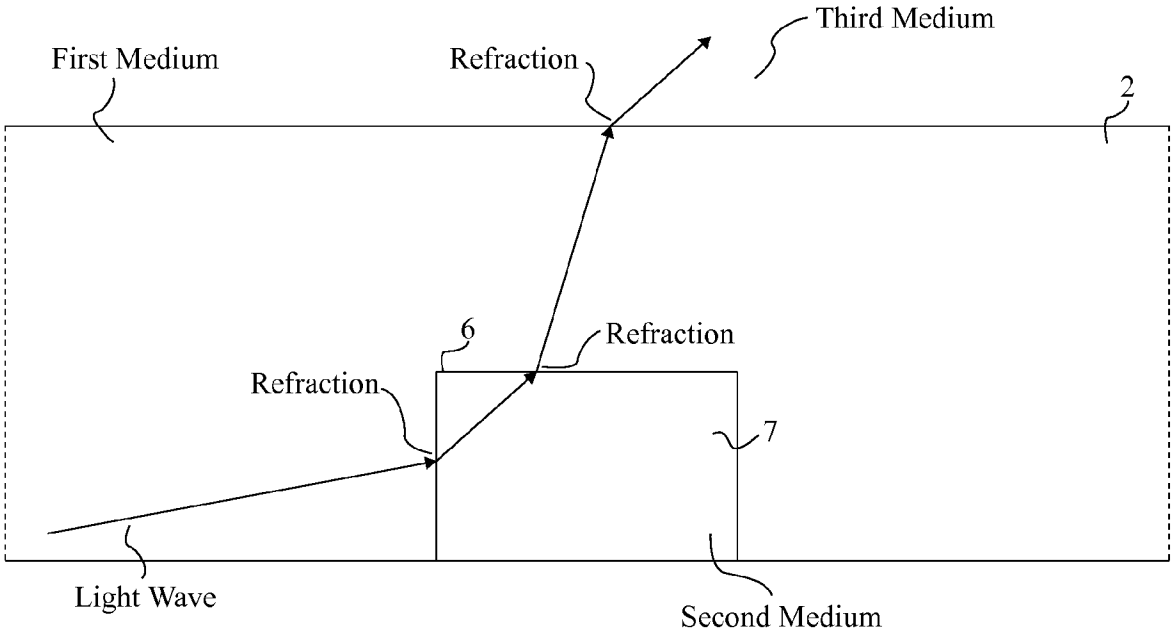
FIG. 2 is an example of a light wave refracting through a cavity and out of a transparent component.

In FIG. 2, the cavity 6 is separate from the external area. This is an example of a boundary section 3 with a refractive index lower than that of the translucent component 2, which fills the cavity 6 in the translucent component 2 with a boundary material 7. In the example of FIG. 2, the light wave approaches the cavity 6 from below the normal. As the light wave crosses the boundary, it is refracted away from the normal. The light wave then continues until it travels from the cavity 6 back into the translucent component 2. As the light wave travels back into the translucent component 2, it is refracted towards the normal. This is because the light wave is moving from the second medium with a lower refractive index to the first medium with a higher refractive index. The light wave then continues traveling through the translucent component 2 until it exits from the translucent component 2 into the external area (assumed to be air), refracting a third and final time. Since the external area is air, it will have a lower refractive index than the translucent component 2. This will lead to the light wave refracting away from the normal as it exits the translucent component 2. In this way, light that originates from the light source 4 can travel through the translucent component 2 and eventually be refracted out of the translucent component 2. To an external viewer, it will appear as though the light wave originated from the cavity 6 of the boundary section 3.

Figure 3:
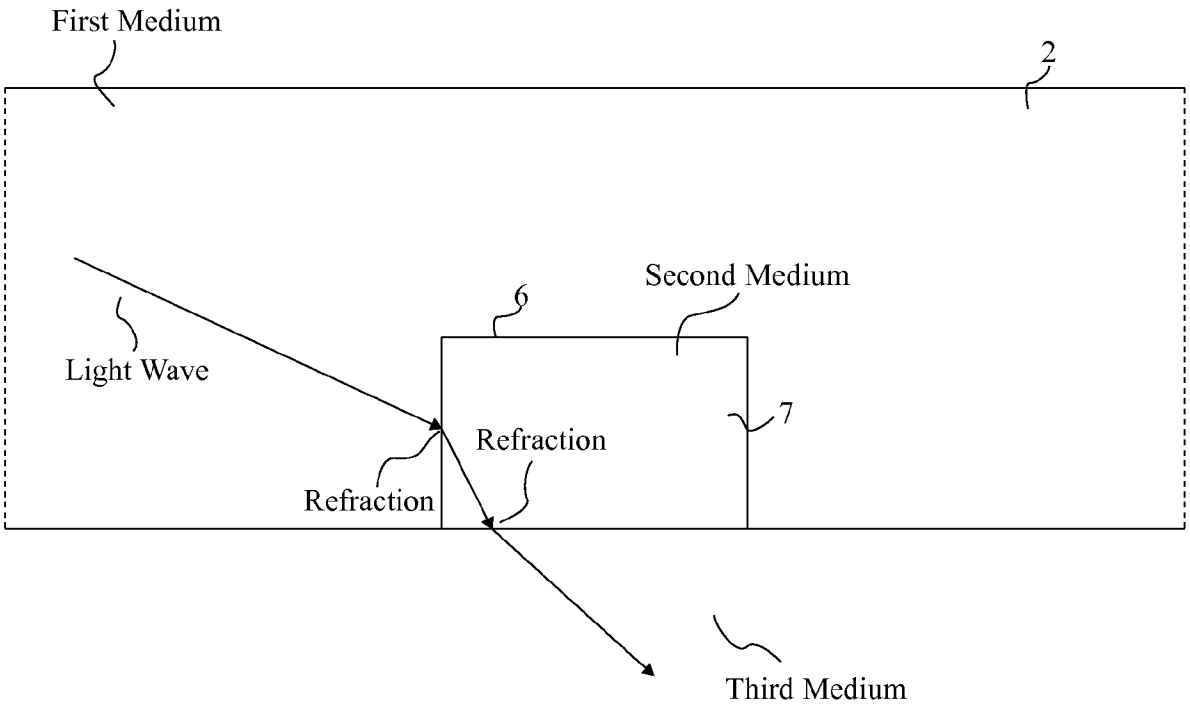
FIG. 3 is an alternative example of how a light wave might refract through a cavity and out of a transparent component.

If the light wave approaches the cavity 6 from above the normal, as in FIG. 3, the light wave will follow a different path. Providing the boundary material 7 has a lower refractive index than the translucent component 2, and assuming the external area is air, the light wave will behave as follows. As the light wave travels from the translucent component 2 to the cavity 6, it bends away from the normal. The light wave then continues until it exits from the cavity 6. As the light wave exits from the cavity 6, it again bends away from the normal. In this instance, the light travels from the translucent component 2, through the cavity 6, and into the third medium in a direction opposite compared to the example illustrated in FIG. 2.

Figure 4:
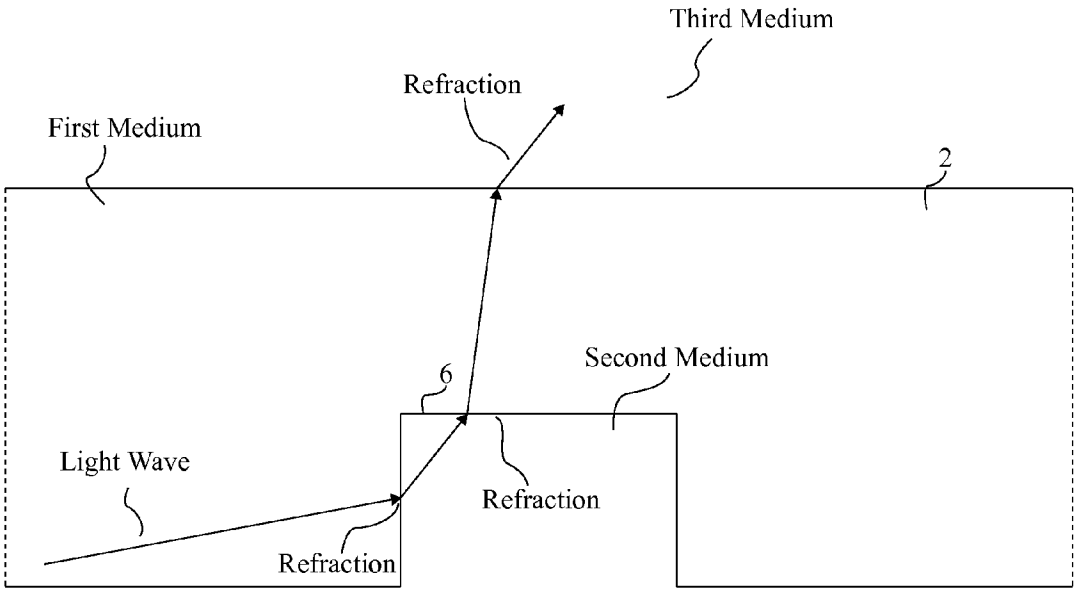
FIG. 4 is an example of how a light wave might refract through and out of a cavity without an added boundary material.

If the boundary section 3 is formed simply by creating an empty cavity 6 in the translucent component 2, instead of filling the cavity 6 with a boundary material 7, the light wave will follow a slightly different path. Providing the boundary section 3 has a lower refractive index than the translucent component 2 and that the external area is air, FIG. 4 shows what would happen in FIG. 2 if the cavity 6 is simply air instead of containing a boundary material 7. In this instance, the light wave refracts more sharply as the light wave travels from the cavity 6 into the translucent component 2. This is due to air having a very low refractive index, very close to a vacuum. While FIG. 4 illustrates both a second medium and a third medium, the second and third medium are actually the same, with the same refractive index. Thus, if the light wave approached from above the normal instead of below the normal, the light wave would not bend when traveling from the second medium into the third medium. Note that does not apply when the light wave approaches from below the normal, like in FIG. 4, since the light wave reenters the translucent component 2 before crossing into the external area.

Figure 5:
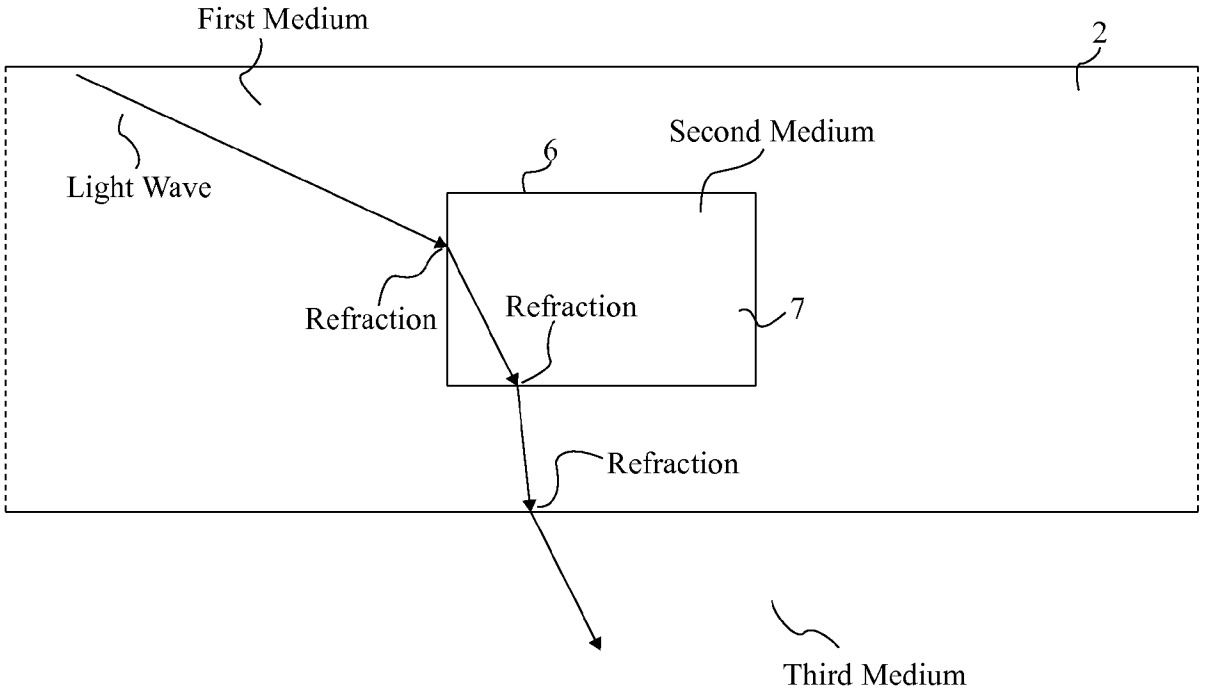
FIG. 5 is an alternative example of how a light wave might refract through a cavity and out of a transparent component.
Figure 6:
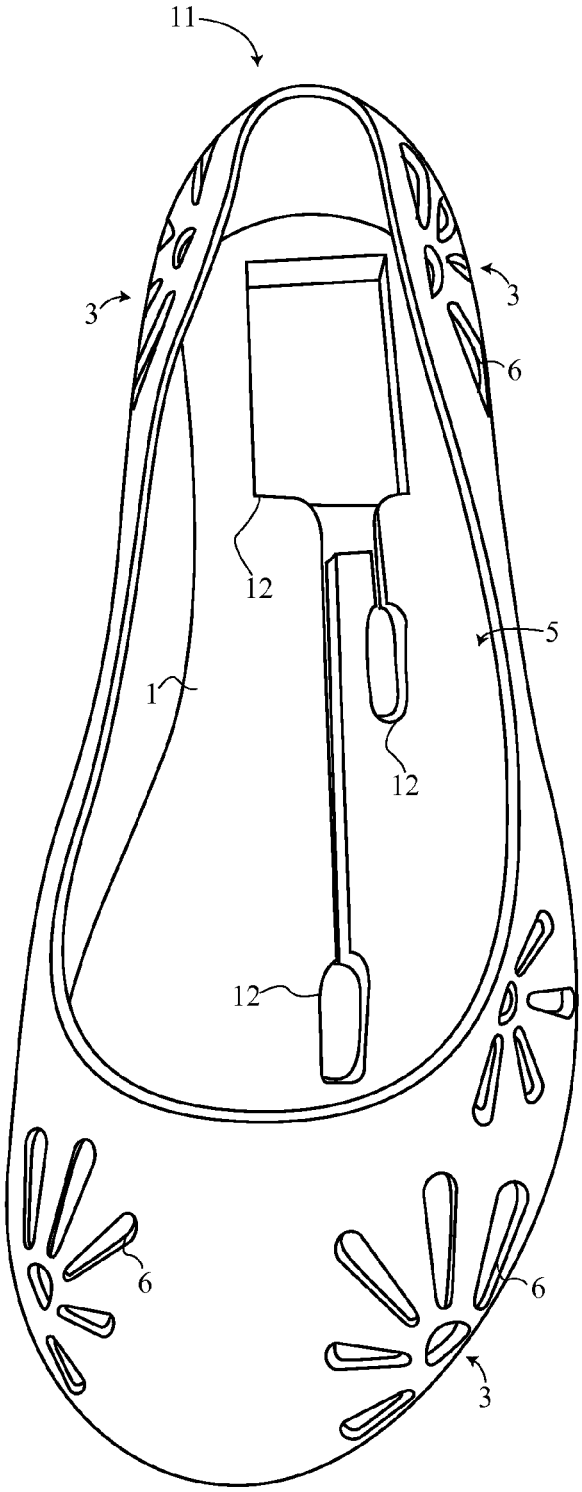
FIG. 6 is a top perspective view of another embodiment of the present invention.
Figure 7:
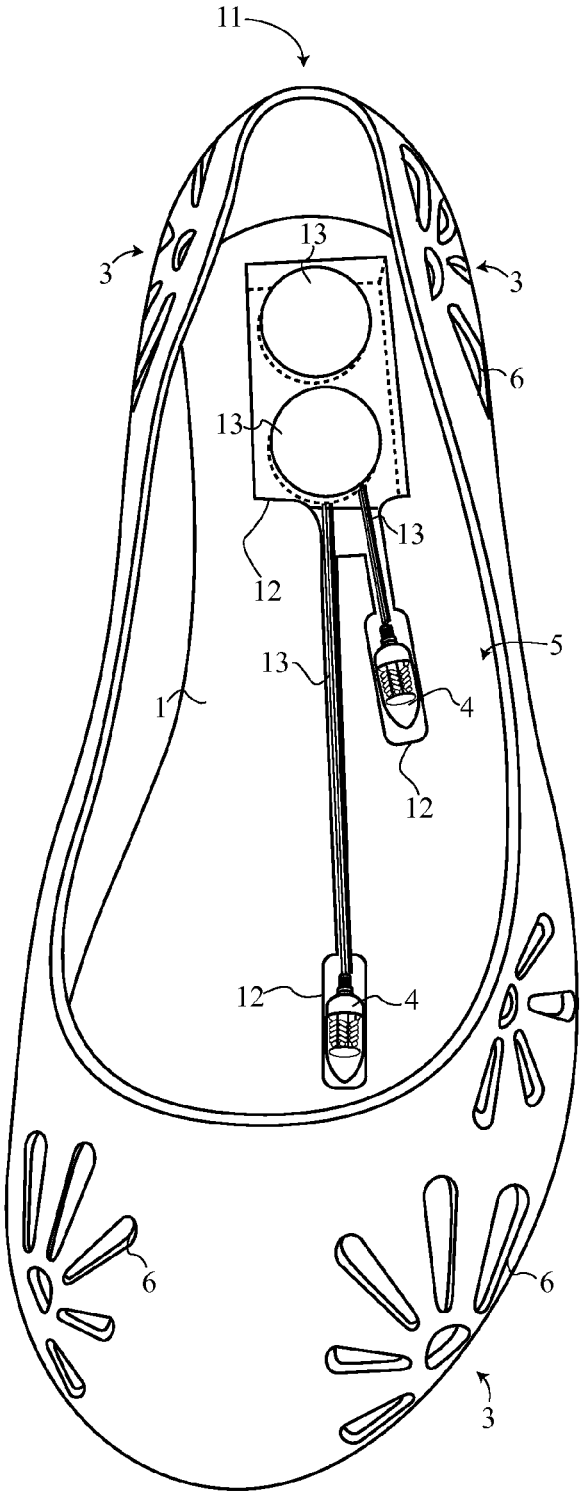
FIG. 7 is another top perspective view of another embodiment of the present invention.

Depending on the boundary material 7, the location of the cavity 6, and the incident angle of the light wave, the light wave could follow numerous different paths. FIG. 5 shows a potential path, assuming a translucent component 2 with a higher refractive index than that of the boundary section 3, in addition to the external area being air. In FIG. 5 the cavity 6 is located in the center of the translucent component 2. Even with the light wave approaching from above the normal, as was illustrated with FIG. 3, the light wave will take a slightly different path than it did in FIG. 3. This is because instead of exiting from the boundary section 3 into the external area, the light wave travels from the boundary section 3 back into the translucent component 2, bending towards the normal. The light wave then exits from the translucent component 2 into the external area, bending away from the normal.

Other variations of the boundary material 7, cavity 6 location, and the angle of incidence of the light wave can slightly change the path of the light wave, but the overall process remains the same; a light wave originates at a light source 4, travels through the translucent component 2, and refracts upon encountering cavities 6 in a boundary section 3, causing the light to exit the translucent component 2 in such a way that it appears to have originated at the cavities 6 of the boundary section 3. In effect, it appears as though each cavity 6 in the boundary section 3 is illuminated as if it were an individual illumination source or an individual light bulb.

Depending on the angle of incidence, it is possible that the light wave will not be refracted out of the translucent component 2 upon encountering a boundary section 3. For instance, if the light wave strikes the cavity 6 completely parallel to the normal, the light wave will not be refracted. Instead, the light wave will pass through the boundary section 3 and reenter the translucent component 2 unaffected.

In other instances, the angle of incidence may be such that the light wave does not ultimately exit the translucent component 2, but instead is reflected at the edge of the translucent component 2. Though some light waves may be reflected, there will also be light waves that cross the cavities 6 at a sufficient angle of incidence to be refracted. Thus, even though some light waves may be reflected, the boundary sections 3 will still refract other light waves, causing them to appear to originate at the cavities 6 in the boundary section 3.

The refraction of the light wave will also depend on the refractive indices of the translucent component 2, the boundary section 3, and the external area. The amount that the light wave bends depends on the difference of the indices of refraction for the materials from which the light wave travels from and to. When crossing between two different materials (such as from the translucent component 2 to the boundary section 3), the light wave will bend more if there is a large difference in indices of refraction, and less if there is a small difference in indices of refraction.

Preferably, the boundary section 3 will have a smaller index of refraction than the translucent component 2. If the boundary section 3 has a larger index of refraction than the translucent component 2, then the light wave will bend towards the normal when passing from the translucent component 2 to the cavities 6 in the boundary section 3. In this case, the light wave is less likely to be refracted out of the translucent component 2, and more likely to be refracted at an angle, which will ultimately result in the light wave being reflected as it encounters the edge of the translucent component 2.

Since the refracted light appears to originate at the cavities 6 in the boundary section 3, boundary sections 3 can be arranged to form illuminated lettering, shapes, and designs. These are just a few examples of what the cavities 6 in the boundary sections 3 can form; in addition to words, geometric shapes, and abstract designs, cavities 6 in the boundary sections 3 can be used to create logos, designs, bevels, embellishments, and in general any visual details desired. An example of cavities 6, in the form of shapes, can be seen in FIG. 1. These features would appear as though they each had their own individual light source 4. In this way, a single light source 4 can be used to illuminate multiple features. Additional light sources 4 can be provided along the translucent component 2. These additional light sources 4 will help to better illuminate boundary sections 3 which are close to the additional light sources 4. If there is only a single light source 4, boundary sections 3 which are further away from the single light source 4 may not be as well illuminated as boundary sections 3 which are close to the single light source 4. The additional light sources 4 could mitigate the lower levels of illumination for boundary sections 3 which are distant from a single light source 4. Ultimately, the boundary sections 3 create a greatly enhanced illumination performance, whether observed in a brightly lit room, in low light, or in the dark.

The boundary sections 3 can be molded, cut, channeled, or in some other way added to the translucent component 2. There are multiple ways of creating the boundary sections 3, with different methods being more suited to different volumes of production. For example, when creating a prototype, the boundary sections 3 can be created simply by using a sharp blade to create penetrations, cavities, or both in the translucent component 2. This method is inexpensive and the time required is not significant when producing a single translucent component 2. If making a larger amount of samples, such as for a trade show, a laser cutting method can be used. While the use of a laser is more expensive than using a knife, the time required will be significantly less. For mass production, even laser cutting can prove too costly in terms of time. In such a situation, molds can be created to make translucent components 2 with boundary sections 3. For mass production, molds will be superior to sharp blades and laser cutting methods.

A dome type shape can be added to the translucent component 2 on a face opposite of where the boundary sections 3 are created. The dome type shape will magnify and otherwise enlarge and distort the illuminated designs created by the boundary sections 3, thus adding additional interest. Separate from, or in addition to boundary sections 3, multicolor graphics could be added to the translucent component 2 in order to further enhance the visual effects created from a dome type shape.

If the boundary section 3 is completely enclosed within the translucent component 2, such as in FIG. 5, then the translucent component 2 may not be able to be constructed as one piece, but rather constructed as separate sections. After cutting or molding the separate sections, the separate sections could then be connected to each other to form the translucent component 2.

Although the invention has been explained in relation to its preferred embodiment, it is to be understood that many other possible modifications and variations can be made without departing from the spirit and scope of the invention as hereinafter claimed.

What is claimed is:

1. A footwear for refracting light from an internal source comprises, a translucent component;

a shoe base;

an insole;

a plurality of refractive boundary sections;

the plurality of refractive boundary sections being formed by a plurality of cavities;

the plurality of cavities comprises a boundary material and an external surface;

the shoe base comprises an electrical housing and a power source;

the electrical housing being recessed into the shoe base;

the power source being positioned in the electrical housing;

the insole being attached to the shoe base, wherein the insole covers the shoe base and the electrical housing;

at least one light source;

the translucent component being connected to the shoe base;

the plurality of refractive boundary sections being positioned along the translucent component;

the plurality of cavities traversing into the translucent component at the plurality of refractive boundary sections;

the light source being connected to the power source; and the light source being connected to the translucent component.

2. The footwear for refracting light from an internal source as claimed in claim 1, wherein the translucent component has a first refractive index and each of the plurality of refractive boundary sections has a second refractive index.

3. The footwear for refracting light from an internal source as claimed in claim 1 comprises, the external surface of the plurality of cavities being coarse.

4. The footwear for refracting light from an internal source as claimed in claim 1 comprises, the plurality of cavities being shaped within the translucent material by the plurality of refractive boundary sections; and the boundary material being positioned within the plurality of cavities.

5. The footwear for refracting light from an internal source as claimed in claim 4 comprises, a plurality of bubbles being encased within the boundary material, wherein the bubbles form small cavities in the boundary material.

6. A footwear for refracting light from an internal source comprises, a translucent enclosure comprises a shoe base;

an insole;

a foot opening;

a plurality of refractive boundary sections;

the plurality of refractive boundary sections being formed by a plurality of cavities;

the plurality of cavities comprises a boundary material and an external surface;

the shoe base comprises an electrical housing and a power source;

the electrical housing being recessed into the shoe base;

the power source being positioned in the electrical housing;

the insole being attached to the shoe base, wherein the insole covers the shoe base and the electrical housing;

at least one light source;

the plurality of refractive boundary sections being positioned along the translucent enclosure;

the plurality of cavities traversing into the translucent enclosure at the plurality of refractive boundary sections;

the light source being connected to the power source; and the light source being connected to the shoe base, wherein the light source illuminates the shoe base and the translucent enclosure.

7. The footwear for refracting light from an internal source as claimed in claim 6, wherein the translucent enclosure has a first refractive index and the plurality of refractive boundary sections has a second refractive index.

8. The footwear for refracting light from an internal source as claimed in claim 6 comprises, the external surface of the plurality of cavities being coarse.

9. The footwear for refracting light from an internal source as claimed in claim 6 comprises, the foot opening being positioned on the translucent enclosure.

10. The footwear for refracting light from an internal source as claimed in claim 9, wherein the foot opening allows a foot to be placed within the translucent enclosure.

11. The footwear for refracting light from an internal source as claimed in claim 6 comprises, the plurality of cavities being shaped within the translucent material by the plurality of refractive boundary sections; and the boundary material being positioned within the plurality of cavities.

12. The footwear for refracting light from an internal source as claimed in claim 6 comprises, a plurality of bubbles being encased within the boundary material, wherein the bubbles form small cavities in the boundary material.

13. A footwear for refracting light from an internal source comprises, a translucent enclosure comprises a shoe base;

an insole;

a foot opening;

the foot opening being positioned on the translucent enclosure.

a plurality of refractive boundary sections;

the plurality of refractive boundary sections being formed by a plurality of cavities;

the plurality of cavities comprises a boundary material and an external surface;

the shoe base comprises an electrical housing and a power source;

the electrical housing being recessed into the shoe base;

the power source being positioned in the electrical housing;

the insole being attached to the shoe base, wherein the insole covers the shoe base and the electrical housing;

at least one light source;

the plurality of refractive boundary sections being positioned along the translucent enclosure;

the plurality of cavities traversing into the translucent enclosure at the plurality of refractive boundary sections;

the external surface of the plurality of cavities being coarse;

the plurality of cavities being shaped within the translucent material by the plurality of refractive boundary sections;

the boundary material being positioned within the plurality of cavities;

the light source being connected to the power source; and the light source being connected to the shoe base, wherein the light source illuminates the shoe base and the translucent enclosure.

14. The footwear for refracting light from an internal source as claimed in claim 13, wherein the translucent enclosure has a first refractive index and each of the plurality of refractive boundary sections has a second refractive index.

15. The footwear for refracting light from an internal source as claimed in claim 13, wherein the foot opening allows a foot to be placed within the translucent enclosure.

16. The footwear for refracting light from an internal source as claimed in claim 13 comprises, a plurality of bubbles encased within the boundary material, wherein the bubbles form small cavities in the boundary material.

* * * * *